United States Patent [19]

Le Duc

[11] Patent Number: 4,916,987

[45] Date of Patent: Apr. 17, 1990

[54] ADJUSTABLE OPEN END WRENCH, 15 DEGREE DUAL HEAD

[76] Inventor: Don Le Duc, 2405 Alvarado Dr., Santa Clara, Calif. 95051

[21] Appl. No.: 430,373

[22] Filed: Nov. 2, 1989

[51] Int. Cl.[4] ..... B25B 13/16

[52] U.S. Cl. ..... 81/77; 81/163; 81/167

[58] Field of Search ..... 81/77, DIG. 4, 163, 81/157, 159–161, 165, 166–167, 170–173

[56] References Cited

U.S. PATENT DOCUMENTS 2,615,358 10/1952 Garno ..... 81/77 X
4,787,275 11/1988 Colvin ..... 81/77

FOREIGN PATENT DOCUMENTS 727194 6/1932 France ..... 81/77

*Primary Examiner*—D. S. Meislin

[57] ABSTRACT

A wrench that combines the narrow profile of an Open End with the adjustability of a large in profile Adjustable wrench and that meets the "Wrench Clearances for Open End Engineers Wrench 15°", (from SAE Aeronautical Drafting Manual). The turnbuckle principle linked to wedge pins that move through crossing slots provide for parallel movement of two slidably connected wrench-halves. Actuation mechanism is shifted from the standard head location to the intermediate portion of the handle and the ends of the wrench are designed for turning two consecutive size ranges.

1 Claim, 1 Drawing Sheet

ADJUSTABLE OPEN END WRENCH, 15 DEGREE DUAL HEAD

BACKGROUND OF THE INVENTION

The four common tools used for turning nuts, screws and bolts are the Socket wrench, Nut Driver, Adjustable wrench and Open End wrench.

The popular Adjustable is undoubtedly reached for before the others, but ironically disappoints the user many times when clearances turn out to be tighter than anticipated.

Selecting the proper size of Open End wrench, especially for the smaller fasteners that could be Metric or SAE, becomes a trial and error game.

By removing any jaw adjustment method from the head of the wrench and locating it in the handle, the new head profile is sized down to become comparable with that of Open End wrenches.

A considerable amount of users time and frustration will be saved by this design.

SUMMARY OF THE INVENTION

Accordingly, it is an object of the invention to provide an improved wrench of narrow head profile and two heads are offered, one at each end of the wrench.

Shown here is a six inch wrench. The small head is compared with a four inch Adjustable and adjusts for 6 through 12 MM's. The large head is compared to a six inch Adjustable and adjusts for 6 through 19 MM sizes. This total range also accommodates for 11 SAE sizes, so that the wrench is good for replacing 25 individual Open End Wrenches. An eight inch wrench size of the present invention covers 13 SAE and 17 Metric sizes, 30 total. A further improvement is ergonomically, in that the thicker handle fits more comfortable in the palm of the hand.

Another improvement over the conventional Adjustable is the location of the adjustment knurl away from the head that makes it possible to adjust the jaws over fasteners that are positioned in deep, with little overhead, spaces. Jaw adjustments are made speedily because the dual head design already has the wrench close to the size of the fasteners. The two wrench-halves with their fixed jaws vs. a separate movable jaw are of simple forging die design in that they are nominally flat. The internal adjustment mechanism is at all times sealed off from dirt and grease, so that the actuator, wedge pins and directional slots are prevented from eventual damage and this is accomplished in a unique way that allows the wrench to stay inside cosmetically and comfortable operational limits.

DESCRIPTION OF THE PREFERRED EMBODIMENT

The tool consists of wrench-half 5, near side, and wrench-half 2, far side. Jaws 3*a* and 3*b* slide against jaws 4*a* and 4*b* within close tolerances so that end shock or pressures are absorbed by both wrench-halves.

Figure 1:
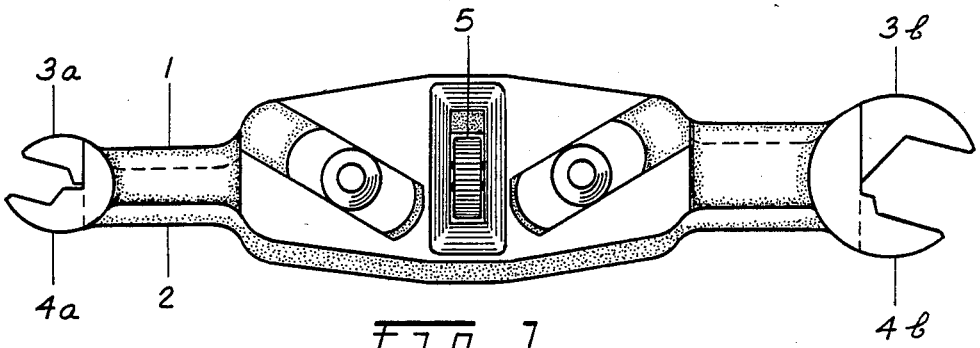
FIG. 1 is a side view of the tool with the jaws closed.
Figure 2:
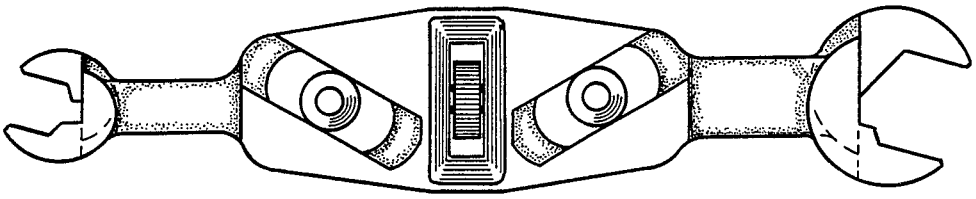
FIG. 2 is a side view of the tool adjusted midway.
Figure 3:
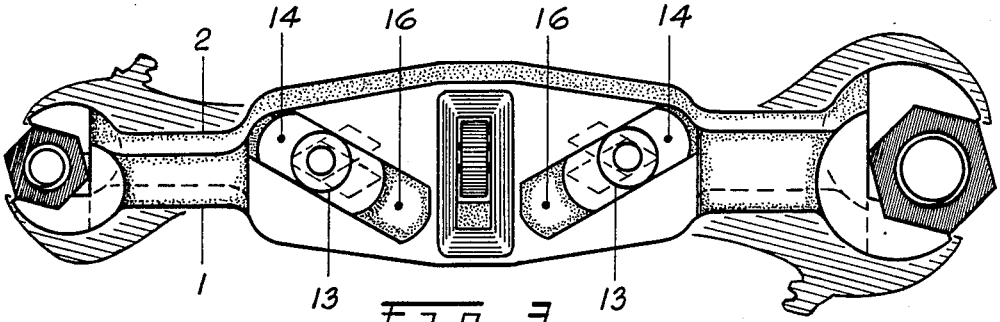
FIG. 3 is a side view of the tool with the jaws opened and includes a profile of a standard 4 inch Adjustable head at the left and a 6 inch Adjustable profile at the right for size comparison.
Figure 4:
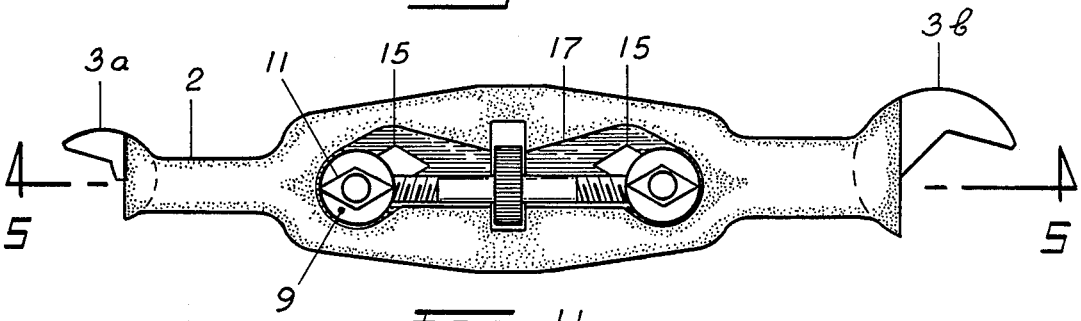
FIG. 4 shows the sliding face of the far wrench-half with actuator and wedge pins installed.
Figure 5:
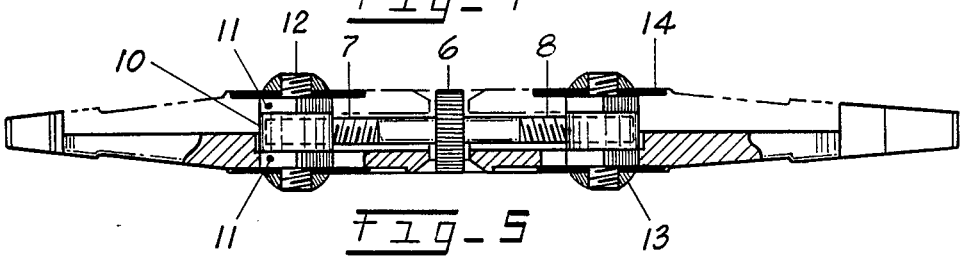
FIG. 5 is a cross section taken upwardly through FIG. 4, but leaves actuators undisturbed.

An actuator 5 has a centered knurled wheel 6, FIG. 4, a left-hand 7 and a right-hand 8 threaded spindle. Accepting these threaded spindle ends are two identical wedge pins 9. The wedge pins are formed with a centered circular portion 10 that is threaded for receiving one spindle end. The circular portion transforms to diamond-shaped portions 11 on both sides and then to threaded short studs 12, there for receiving the wrench clamping nuts 13. Prior to the nuts however are slip-on thin washers 14 that cover up slots 15 (4 total); channel-like depressions 16 in the wrench-halves guide these washers in the direction, and over the lengths of slots 15 that are angularly offset from the longitudinal centerline of the wrench. One pair of these slots in each wrench-half converge toward each other and to the centerline at a 30° angle on either the left or the right-hand side of that centerline to for two pairs of crossing slots in the assembly.

Forces produced by wrench torque are absorbed by the diamond-shaped portions of the wedge pins which in turn transmit them to the sides of the slots in which they are abutted to. The wedge pin diamonds nearest the wrench head that is torqued are attempted to be wedged toward the head, but the connected actuator spindle that is kept in place by the opposite diamonds' restriction, stops motion in that direction. The lengthy thread engagement of the sized spindle with the round portion of the wedge pin are the most important features of the wrench from the point of strength. In the standard Adjustable, torque forces are directed into four short segments of the spiral of the adjusting knurl; different but similar.

The end faces of the circular portion 9 are in close sliding clearance contact with the base surfaces of depressions 17 that are formed in the handle portions of both wrench-halves and force the wedge pins to stay perfectly perpendicular in respect to the entire wrench body and in this manner counter shear and compression into the slots best. The flat surfaces of the diamonds distribute loading evenly and thus resist wear.

The button shaped assembly nuts 13 could give way to flat head retainers that would keep both wrench-halves substantially even for comfortable grip.

What is claimed is:

1. A wrench comprising two substantially flat wrench-halves each having a jaw at each end of a narrowed neck portion connected to a centered handle portion, and each wrench half having a sliding side for engagement with each other for slidable sideways movement;

each jaw having a shoulder on the sliding side of its corresponding wrench half, said shoulders lying perpendicular to a longitudinal centerline of the tool, at the transition of said neck portions to provide guides for said slidable side movement;

said handle portions each having a recess in the sliding side thereof, each recess having a bottom surface, and a rectangular cutout centered between a pair of angularly equal slanted slots all located in the bottom surface of each recess;

an actuator consisting of a spindle that has a left-hand threaded portion on one end and a right-hand threaded portion on its other end, and a knurled wheel centered on said spindle, said knurled wheel being located in said rectangular cutouts;

first and second wedge pins each having a circular portion, a diamond shaped portion on both sides of said circular portions, and a threaded stud portion extending from each diamond shaped portion;

said circular portions being threaded to respective opposite ends of said spindle, said diamond shaped portions extending within a respective slanted slot;

a pair of slanted guideways provided in an exterior side of each of said handle portions, each guideway being centered over a respective slanted slot;

a long and thin washer extending in each slanted guideway, and having a center clearance hole for mounting over a respective threaded stud portion to cover said slanted slots over the entire wrench adjustment;

a retainer engaging each threaded stud portion for assembling said two wrench-halves.

* * * * *